United States Patent [19]

Kohyama

[11] Patent Number: 4,653,426

[45] Date of Patent: Mar. 31, 1987

[54] DEVELOPING APPARATUS

[75] Inventor: Mitsuaki Kohyama, Higashikurume, Japan

[73] Assignee: Kabushiki Kaisha Toshiba, Kawasaki, Japan

[21] Appl. No.: 739,878

[22] Filed: May 31, 1985

[30] Foreign Application Priority Data

Jun. 1, 1984 [JP] Japan ..... 59-110906

[51] Int. Cl.[4] ..... G03G 15/06

[52] U.S. Cl. ..... 118/651; 118/653

[58] Field of Search ..... 118/651, 653

[56] References Cited

U.S. PATENT DOCUMENTS

| | | | |
|---|---|---|---|
| 3,232,190 | 2/1966 | Willmott | 95/1.7 |
| 3,893,418 | 7/1975 | Liebman et al. | 118/637 |
| 3,924,943 | 12/1975 | Fletcher | 355/3 R |
| 4,124,483 | 11/1978 | Christenson | 204/299 R |
| 4,378,158 | 3/1983 | Kanbe | 118/651 |
| 4,508,052 | 4/1985 | Kohyama | 118/651 |

FOREIGN PATENT DOCUMENTS

| | | |
|---|---|---|
| 3100965 | 11/1981 | Fed. Rep. of Germany . |
| 1533311 | 11/1978 | United Kingdom . |

*Primary Examiner*—Bernard D. Pianalto

*Attorney, Agent, or Firm*—Schwartz, Jeffery, Schwaab, Mack, Blumenthal & Evans

[57] ABSTRACT

A developing apparatus in which a toner carrying surface is provided spaced opposite an electrostatic latent image surface to form a very small gap therebetween, and A.C. bias voltage is applied to the gap to jump toner to an electrostatic latent image portion, wherein the A.C. voltage applied to the gap has a frequency which varies with time, and the toner is jumped to the electrostatic latent image portion under influence of an alternating electric field established by the A.C. voltage, increasing the toner particle jumping possibility and improving the gradation and denseness properties of the resulting developed image.

11 Claims, 8 Drawing Figures

DEVELOPING APPARATUS

BACKGROUND OF THE INVENTION

1. Field of the Invention

The present invention relates to developing apparatuses for use in an electrophotographic copying machine or the like, and more specifically, to an improved developing apparatus in which a toner surface is provided spaced opposite an electrostatic latent image surface to define a very small gap therebetween, and an A.C. bias voltage is applied across the gap to let toner fly and attach to the latent image portion.

2. Description of the Prior Art

For an electrophotographic copying apparatus widely applied to electronic copying machines, facsimile equipment, printers and the like, there has been so far employed mainly a developing method such as a cascase method or a magnetic brush method. Recently, there has been an increasing demand for putting color recording to practical use. In order to meet such demand, studies have been made to develop an image on photosensitive material allowing the superimposed development of an unifixed image on a non-contact basis. This developing method is generally called a noncontact developing method, and its basic principle is described in British Pat. No. 1,458,766, and U.S. Pat. Nos. 3,866,574 and 3,893,418. According to the inventions shown in these patents, a cylindrical roll whose surface carries a uniform thin layer of toner is provided close to an electrostatic latent image surface (the gap therebetween is between about 5 and 500 $\mu$m) and a biased A.C. voltage is applied to the gap thereby causing the toner to vibratingly fly so as to selectively attach the toner to the electrostatic latent image portion having a potential higher than a predetermined level. U.S. Pat. No. 3,893,418 discloses a developing method wherein graduation reproducibility is selected through frequency switching on the basis of the fact that the property of a developed image varies depending on the frequency of an applied A.C. voltage.

As a result of investigations into such noncontact developing methods, it has been found that, in addition to the conventional analysis that the toner flying characteristic depends largely on such external factors as the magnitude and frequency of the applied A.C. voltage, the properties and conditions of toner itself are greatly affected by these external factors and thus it is substantially meaningless to determine the developing conditions only with reference to these external factors.

That is, it has been found that in non-contact developing systems the requirements of the A.C. voltage to be applied vary depending on the amount of electricity charged in the toner and on the particle diameter (weight) of the toner, and that the optimum frequency and voltage for the highest toner flying sensitivity also vary from toner to toner. Consequently, to compensate for variations in toner it is necessary to have some means capable of adjusting the A.C. voltage with reference to variations in the charged amount and the diameter of the toner particles in actual application. In other words, the conventional non-contact developing system which does not make such adjustments requires toner having only small variations in charged amount and particle diameter. Such toner is difficult and expensive to produce. According to the current toner production techniques, it is actually inevitable that such properties of toner vary to some extent. For this reason, toner's flying efficiency and developed result are not currently satisfactory.

Further, the conventional developing method of applying a voltage of constant frequency is defective in that, through the method can provide a high resolving power because only a narrow range of specific toner particles can fly, it has a poor image denseness and gradation reproducibility compared with the conventional magnetic brush developing method.

SUMMARY OF THE INVENTION

It is an object of the present invention, therefore, to provide a developing apparatus with high sensitivity which flies not only a narrow range of toner particles but a wide range of toner particles to provide excellent image graduation and denseness properties.

According to the present invention, this object can be attained by changing the frequency of the alternating electric field to be applied on the basis of the fact that toner particles have specific property range remarkably respond to an alternating electric field having a specific frequency.

A developing apparatus in accordance with the present invention comprises a carrier for carrying developer thereon and provided spaced opposite an electrostatic latent image holder to form and maintain a very small gap between the developer carrier and latent image holder in a developing region, and means for applying an A.C. voltage, whose frequency varies with time, to the gap to eventually selectively transfer the developer to the latent image holder under the influence of an alternating electric field established by the A.C. voltage.

Since the A.C. voltage applied by the voltage applying means causes no non-uniformity of development, it is preferable that the frequency of the A.C. voltage cyclically varies stepwise with a plurality of different frequency values, and the cyclically changing frequency period of the A.C. voltage occurs at least once, and desirably more than once, in the time interval during which an electrostatic latent image on the holder passes through an effective developing region (in which developing operation is allowed) in the area between the opposed developer carrier and holder.

In accordance with the present invention, a non-contact type developing apparatus can be provided that can responsively jump or fly a larger number of toner particles with excellent gradation and denseness properties while not placing severe restrictions on the toner particle property variations.

DETAILED DESCRIPTION OF A PREFERRED EMBODIMENT

Figure 1:
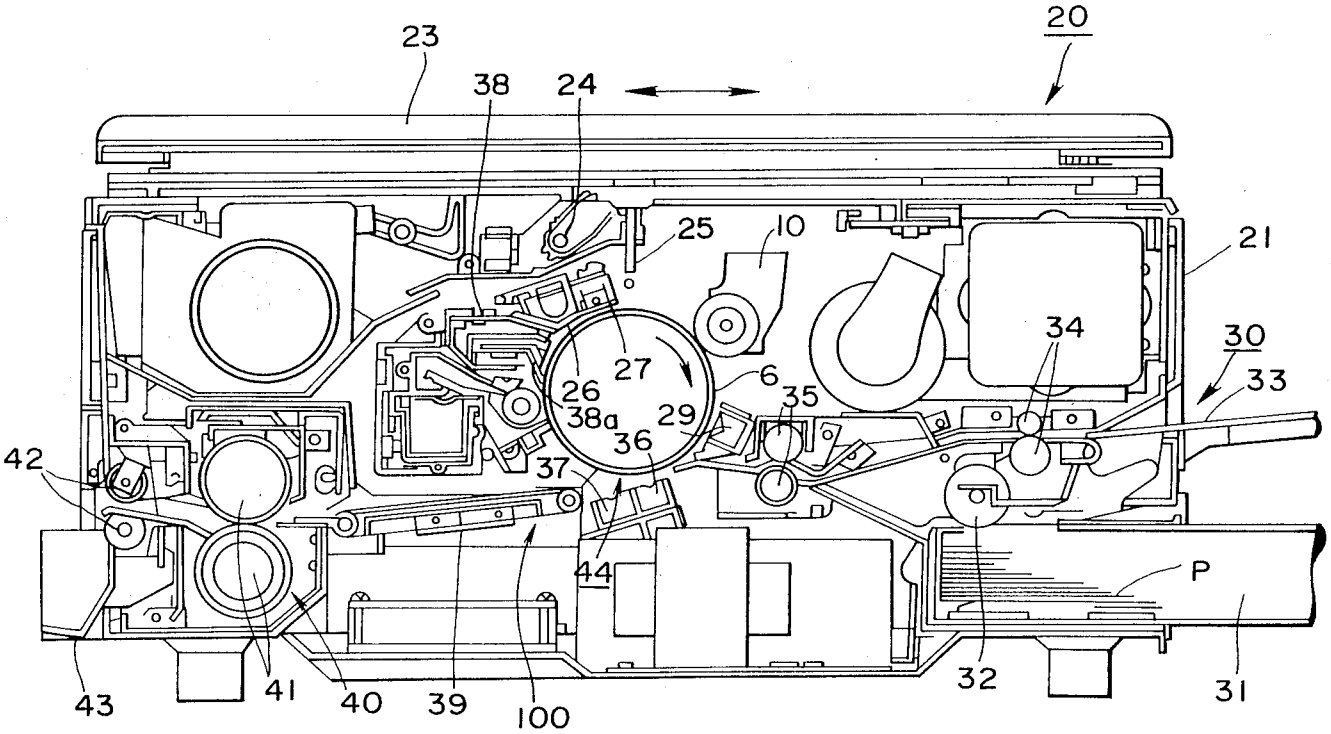
FIG. 1 is a cross-sectional view of an electronic copying machine to which the present invention is applied.

The present invention will be described with reference to the preferred embodiment shown in the drawings.

Referring to FIG. 1, there is shown, in section, an electronic copying machine 20 which comprises a developing apparatus 10 embodying the present invention.

First of all, the copying machine 20 will be briefly explained. In the drawing, a machine casing 21 is provided at its top with a horizontally reciprocable document table 23. Rotatably disposed nearly in the center of the casing 21 is a photosensitive drum 6 which is made of amorphous selenium. Provided around the drum 6 are a charger 27, an optical system for light exposure comprising a lamp 24 and a lens array 25, the developing apparatus 10 embodying the present invention, a pretransfer charger 29, a transfer charger 36, a release charger 37, a cleaning device 38 including a cleaning blade 38*a*, and a charge removing lamp 26. The casing 21 is provided at its one side with a paper supply part 30 which comprises a paper supply cassette 31 removably mounted in the casing 21, a roller 32 is contact with the top sheet of a supply of recording papers P for supplying a recording paper P in the paper supply direction, and a roller 34 for feeding a recording paper inserted through a manual paper supply guide 33 in the paper supply direction. Provided between the paper supply part 30 and fixing device 40, described hereinafter, is a paper feeding part 44 which feeds the recording paper P via a transfer part including the transfer charger 36. The feeding part 44 comprises a resist roller 35 for feeding the recording paper supplied from the paper supply part to the transfer part at a predetermined time, and a belt 39 for feeding the recording paper from the transfer part to the fixing device 40. Provided next to the feeding part 44 in the fixing device 40 which includes a pair of heated rollers 41. Disposed between one side of the casing 21 and the fixing device 40 are a pair of rollers 42 which discharge the recording paper from the casing and a tray 43 which receives the discharged paper.

The basic copying process of the electronic copying machine 20 arranged as described above will be explained. The light sensitive drum 6 is uniformly charged in advance at about 700 V by the charger 27. Then an original document (not shown) placed on the document table 23 is irradiated by the lamp 24 so that the reflected light will form an image on the drum 6 through the lens array 25, thus forming an electrostatic latent image on the drum 6. The electrostatic latent image is developed by the developing apparatus 10 (which will be described in detail later), and then charges on the drum 6 are removed and at the same time the toner is charged by the pretransfer charger 29 (800 Hz A.C. corona charger biased by about 800 V on the positive side), which results in the image being put in an easily transferable state. The recording paper supplied from the paper supply part 30 to the transfer part is charged by the transfer charger 36 (positive D.C. corona charger), and subsequently the charges on the paper are removed by the release charger 37 (A.C. corona charger) to provide transfer of the image to the paper and release of the paper from the drum 6. The recording paper is fed via the belt 39 to the fixing device 40 in which the paper is heated to a temperature between about 170° to 180° C. and compressed by the heated rollers 41 to fix the image. The fixed paper is discharged from the casing, completing the copying process. The toner still remaining on the drum 6 after the transfer step is removed by the cleaning blade 38*a* of the cleaning device 38, and charges remaining on the drum 6 are erased by the lamp 26 to prepare for the next cycle.

Figure 2:
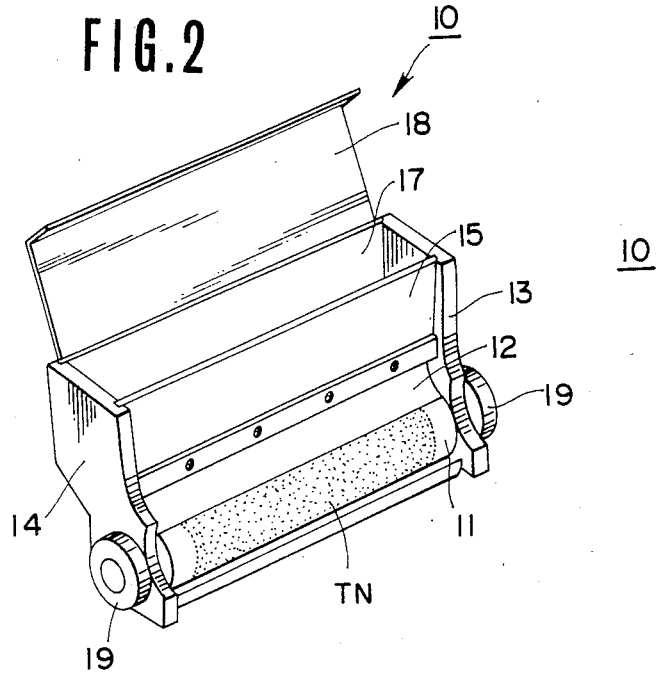
FIG. 2 is a perspective view showing an embodiment of a developing apparatus in accordance with the present invention.
Figure 3:
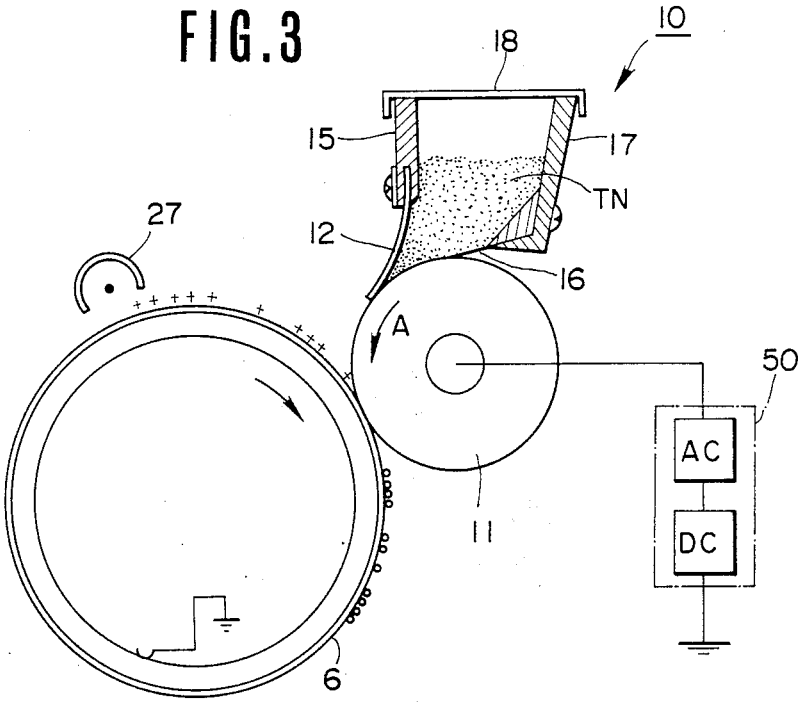
FIG. 3 is a schematic cross-sectional view of a major part of the apparatus of FIG. 2.

Explanation will next be directed to the developing apparatus 10 in accordance with the present invention. FIG. 2 is a perspective view of the developing apparatus 10 and FIG. 3 is a cross sectional view of a major part of the apparatus. In these drawings, the developing apparatus 10 comprises a developing roller 11 and a toner coating blade 12. The roll 11 is journalled in side frames 13 and 14 forming part of the casing of the apparatus 10 and rotates at the same speed as the rotational speed of the drum 6 in a direction shown by an arrow A in FIG. 3. The blade 12, which is made of a stainless or phosphor bronze plate having a thickness of about 100 μm, is fixed at its one end to a front frame 15 forming a part of the casing and is pressed at its other end against the developing roll 11, i.e., in a face abutting state to the roll 11. A blade 16 for preventing toner leakage, which is made of a polyester film having a thickness of about 100 μm, is fixed at its one end to a rear frame 17 forming a part of the casing and abuts at its other end against the developing roll 11. The casing is formed to have a toner supply inlet at its top which is selectively closed by a cover 18. Guide rollers 19 are pivotably mounted on the same shaft as the developing roll 11 to provide and maintain a predetermined small gap between the developing roll 11 and the drum 6 when the developing apparatus 10 has been mounted and positioned in place in the electronic copying machine. The small gap between the roll 11 and drum 6 may be set to be narrower than the thickness of the toner layer on the roll 11, but in this embodiment it is desirable to set the gap to be wider than the thickness of the toner layer because toner in the gap tends to be subjected to cohesion. The width of the gap may desirably range from about 50 μm to about 800 μm. Preferably the gap width will lie in the range from about 250 μm to about 300 μm. Further, electrically connected to the developing roll 11 is a biasing voltage supply 50 which applies a D.C. or superimposed A.C. voltage to the gap between the roll 11 and drum 6. The arrangement and operation of the biasing voltage supply 50 will be explained in detail later.

Figure 4:
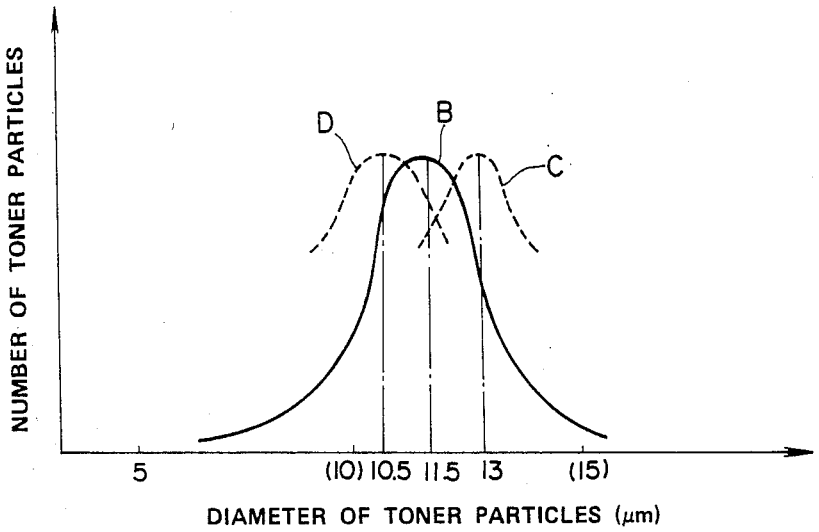
FIG. 4 is a graph showing an example of toner particle diameter distribution.

In operation, when the drum 6 and roll 11 rotate at the same speed (130 mm/sec), toner TN contained within the casing will be moved into a gap between the roll 11 and blade 12 by its own weight so that the toner will be friction charged by the blade 12, thus forming a toner layer having a thickness of between about 30 and 40 μm on the roll 11. The thickness of the toner layer is adjusted by the pressing force of the blade 12 against the roll 11. The toner used in the illustrative embodiment has a particle diameter distribution and has a 50% average particle diameter of 11.5 μm, as shown by a solid line B in FIG. 4. Further, the amount of charge on the roll 11 is 3–30 micro-coulombs/g, and this charge amount tends to decrease as the thickness of the toner layer increases. The drum 6, after having been charged by the charger 27, is subjected to exposure of irradiation light, whereby an electrostatic latent image is formed thereon. As the toner layer on the roll 11 approaches the opposing surface of the drum 6, the developing biasing voltage applied between the roll 11 and drum 6 from the biasing voltage supply 50 as well as the latent image potential on the drum 6 will cause the gradual increase of an electric field in the gap between the roll 11 and drum 6, and toner particles in the toner layer will start flying to the drum 6 from a region in the layer where the force acting on a toner particle satisfies its flying conditions. The developing process will start from this point in such a manner that toner particles fly reciprocatingly in the gap between the drum 6 and roll 11. With rotation of the roll 1 and drum 6, the region of the layer moves away from the gap between the roll 11 and drum 6, and the electric field of the region gradually becomes weak. This developing process will continue until toner particles no longer fly. Toner particles can actually fly out of the toner layer only in this small gap region located between the drum 6 and roll 11, and this region will be referred hereinafter to as the "effective developing region". The reciprocating movement of toner particles under the influence of the alternating field will be different for an electrostatic latent image portion and a non-electrostatic latent image portion (portions on the drum 6 where an electrostatic latent image is formed and not formed), because the portions are subjected to different electric fields. In addition, since toner particles have different characteristics from each other, the flying phase of toner particles will be completely random. However, it is believed that development is carried out in such a manner that, during vibration, some of the toner particles are attracted by and attached to the electrostatic agent image portion and some are returned back to the roll 11. In other words, not all the toner particles will move reciprocatingly throughout the entire gap.

Next, the development of the biasing voltage applied across the gap between the drum 6 and roll 11 by the biasing voltage supply 50 will be explained.

Figure 5:
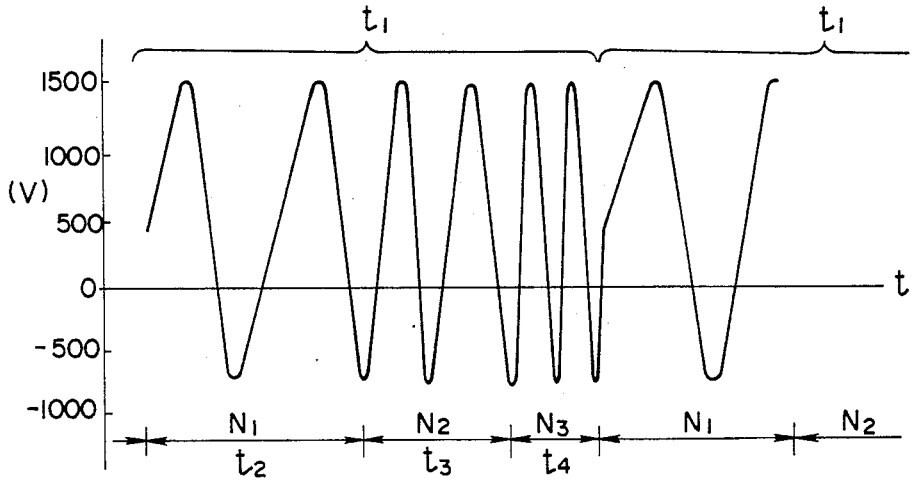
FIG. 5 is a waveform of a developing bias voltage supplied from a bias power supply in the apparatus of FIG. 2.

FIG. 5 shows an example waveform of the developing biasing voltage output of the biasing voltage supply 50, in which the developing voltage is an A.C. voltage with its peak value being 1100 V, which is biased on its positive side by about 400 V, and the frequency of which varies cyclically in three frequencies $N_1$, $N_2$ and $N_3$. In order to avoid non-uniformity in development, the period $t_1$ of cyclically changing frequencies is preferably set so that it occurs at least once, and desirably more than once, during the time in which the electrostatic latent image passes through the effective developing region between the drum 6 and roll 11. Taking the above into consideration, the application times $t_2$, $t_3$ and $t_4$ of the biasing voltage having frequencies $N_1$, $N_2$ and $N_3$, respectively, must be set. In the described embodiment, $N_1$, $N_2$, $N_3$ and $1/t_1$ are set to be 400 Hz, 800 Hz, 1400 Hz and 110 Hz, respectively. These settings are made because, as result of changing the frequencies of the biasing voltage to determine the best quality of developed image, it has been found that with respect to three types of toners having 50% average particle diameters of 11.5 μm, 13 μm and 10.5 μm, respectively (corresponding to distribution curves B, C and D in FIG. 4) the optimum frequencies are 800 Hz, 1400 Hz, and 400 Hz, respectively.

In this way, since the voltage having cyclically changing frequencies is applied to the effective developing region, toner having a wide range of particle diameters can contribute to development in this embodiment, improving its developing efficiency with remarkably excellent gradation reproducibility. In the prior art, only toner having a limited range of particle diameters contributed to development. Further, the present invention is less affected by variations in its average particle diameter (the particle diameter distribution of toner is usually different for different toner production lots), and thus the invention can provide a stable quality characteristic in reproduced images produced with different lots of toner.

Figure 6:
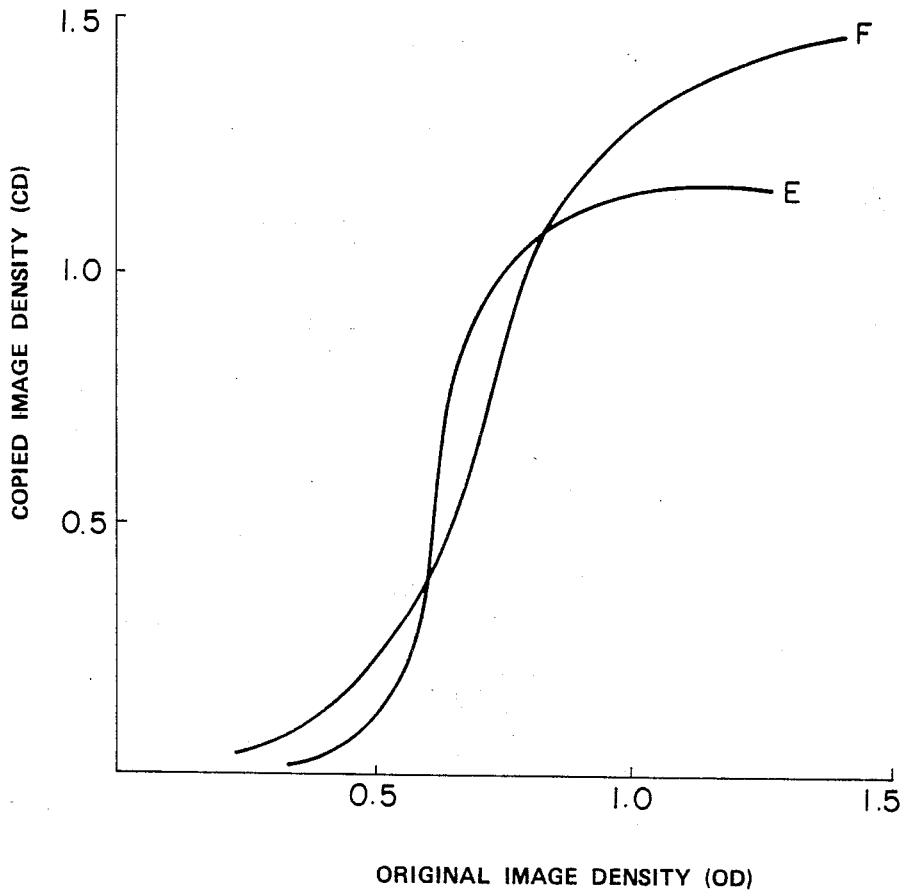
FIG. 6 shows graphs of gradation reproducibility with respect to the present invention and a prior art device.

Referring to FIG. 6, there are shown graphs E and F of the gradation reproducibility of a representative prior art system and of the present invention, in which the abscissa axis indicates original image density (OD) and the ordinate axis indicates copied image density (CD). The gradation reproducibility represents the degree of fidelity with which the gradation of an original image is reproduced. The image density D is defined according to the formula $$D = -\log_{10}(I_W/I_B)$$

wherein $I_B$ is the intensity of the incident light and $I_W$ is the intensity of the reflected light. The curve E shows the result when an A.C. voltage having a single frequency (800 Hz) is applied as in the prior art, while the curve F shows the result when an A.C. voltage having three different frequencies (400 Hz, 800 Hz and 1400 Hz) is applied according to the present invention. It will be seen from FIG. 6 that the present invention has a reproduced gradation range much wider than that of the prior art. As will be understood from the above explanation, the reproducibility may be varied by changing the values of the frequencies $N_1$, $N_2$ and $N_3$. For a different toner average particle diameter and distribution, it is necessary to employ another combination of frequencies.

Figure 7:
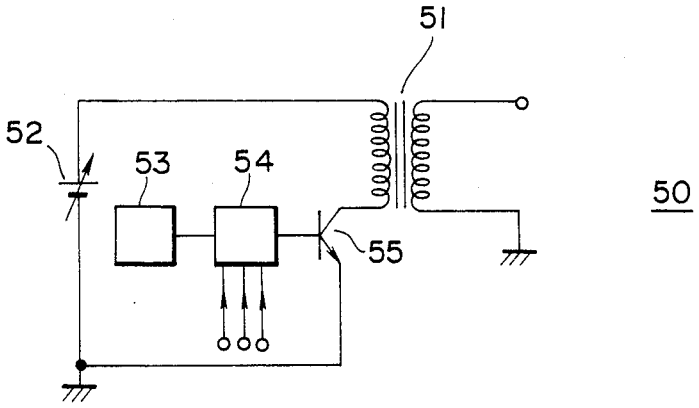
FIGS. 7 and 8 are circuit diagrams of different embodiments of the bias power supply in accordance with the present invention.
Figure 8:
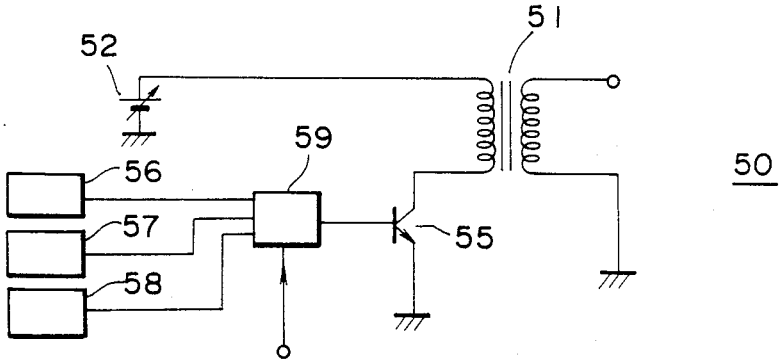

FIGS. 7 and 8 show detailed arrangements of different embodiments of the bias power supply 50 which outputs an A.C. voltage having three types of frequencies. The arrangement of FIG. 7 comprises a boosting transformer 51, a variable D.C. power source 52, an oscillator 53 for generating an oscillation signal having a predetermined frequency, a programmable frequency divider 54 having three different frequency division ratios which are cyclically switched, and a switching circuit 55 for turning ON and OFF to pass and stop a current from the D.C. power source 52 to the boosting transformer 51 and generate an A.C. voltage of three frequencies in the secondary winding of the transformer 51.

In the arrangement of FIG. 8, on the other hand, in place of the oscillator 53 and programmable frequency divider 54 of FIG. 7, there are provided three oscillators 56, 57 and 58 which generate oscillation signals having three different frequencies, respectively, and a switching circuit 59 such as an analog switch. When the switching circuit 59 is operated to select one of the outputs of the oscillators 56 to 58 and apply the selected one to the switching circuit 55, the arrangement of FIG. 8 will generate a high A.C. voltage of three frequencies varying with time in a manner similar to the arrangement of FIG. 7.

The influence of toner particle diameter exerted on the developing characteristic is attributed to the toner particle's weight, air viscosity resistance to its flight, its inertia force and so on, and thus the optimum frequencies of the biasing voltage vary depending not only on the toner particle diameter but also on the specific gravity of the toner material. For this reason, a desirable effect will be expected by controlling the output frequency of the biasing voltage supply in reference to the specific gravity of the toner material together with the diameter of the toner particles.

Due to the fact that the amount of electricity charged in toner is affected strongly by the toner flying sensitivity and the proper application voltage and that its frequencies tend to vary depending on the charge amount in the toner, the present invention is also considered effective to accommodate variations in the charge amount distribution. However, the effectiveness of the present invention for such variations cannot be confirmed because there is no way of measuring the toner charge distribution. In any case, the maximum density and gradation reproducibility of the image obtained by this embodiment, are remarkably improved when compared with those of the prior art, as seen from FIG. 6. It will be appreciated that such improvement results from the fact that, though toner varies in the distribution of its particle diameter, specific gravity and so on, application of an alternating electric field having a similar time-to frequency distribution to the effective developing region will cause an increase in the amount of toner particles "activated". In other words, according to the prior art method of applying a voltage having a constant frequency, it is possible to activate only a specific small portion of all the toner particles which corresponds to the applied voltage frequency.

As has been disclosed in the foregoing, in accordance with the present invention, there is provided a non-contact type developing apparatus in which toner having non-uniform particle diameter and charge amount distribution properties is effectively jumped or controlled by providing a similar distribution property to the frequency of the A.C. bias voltage applied from the bias power supply 50, whereby the allowable range with respect to toner property variations can be enlarged with excellent image quality, although in the past this has been regarded as impossible.

Although three types of frequencies $N_1$, and $N_2$ and $N_3$ have been used for the application voltage in the above embodiment, two types of frequencies may be employed with good results compared to the prior art. Of course, more than three types of frequencies may also be used. The biasing potential for the application voltage varies depending on the charge polarity of the charged potential of the drum 6 and the charge polarity of the toner, and thus the biasing potential must be set taking background conditions into consideration.

The present invention is not limited to the described illustrative embodiment, and thus it should be understood that, especially, the set frequency range, frequency values, frequency type, biasing potential and waveform of the A.C. application voltage may be modified in various ways within the scope of the present invention. Further, in the described embodiment the frequency of the A.C. application voltage has been switched stepwise to different values, but the frequency of the application voltage may be changed continuously from a predetermined value. In the present invention, basically, an A.C. voltage, whose frequency varies with time, is applied to the developing gap between the drum 6 and roll 11 to increase the amount of activated toner particles and to change the vibratory state of toner particles moving back and forth in the developing gap, whereby the jumping distance of toner particles can be widely changed, controlling the possibility of toner's attachment onto electrostatic latent image portions and the possibility of toner's return from the non-electrostatic latent image portions. Further, the construction of the apparatus and of the toner material can be widely selected. The shape of the developing apparatus according to the present invention is illustrated merely as an example, and the invention is not limited to the illustrated shape. The invention may be applied to one or two component type magnetic developing apparatus in the same manner, providing the same effect. (In two component type apparatus, only a small diameter carrier with high resistivity can be used.) In a magnetic toner application, the frequencies of the application voltage are preferably set to be somewhat lower (between 1 KHz and 600 Hz) than those of the above embodiment.

While the present invention has been described with reference to the preferred embodiment shown in the drawings, it should be understood that the intention is not to limit the invention only to the particular embodiment shown but rather to cover all alternatives, modifications and equivalent arrangements possible within the scope of appended claims.

What is claimed is:

1. A developing apparatus comprising:

a developer carrier (11) for carrying developer thereon and provided spaced opposite an electrostatic latent image holder (6) to form and maintain a very small gap between said carrier (11) and said holder (6); and voltage applying means (50) for applying an A.C. voltage having a frequency which varies with time across said gap between the carrier (11) and holder (6), whereby said developer is successively caused to fly under the influence of an alternating electric field established by said A.C. voltage and to be selectively attached to the image holder (6).

2. A developing apparatus as set forth in claim 1, wherein said A.C. voltage from said voltage applying means (50) has a period in which a plurality of different frequencies sequentially appear.

3. A developing apparatus as set forth in claim 1, wherein said A.C. voltage from said voltage applying means (50) has a period in which a plurality of different frequencies sequentially appear, and said A.C. voltage is set so that said period occurs at least once during a time in which an electrostatic latent image on said holder (6) passes through an effective developing region in an area between said developer carrier (11) and said holder (6).

4. A developing apparatus as set forth in claim 1, wherein said voltage applying means (50) comprises a transformer (51) having primary and secondary sides, a D.C. power source (52) connected to the primary side of said transformer, a switching circuit (55) for passing and stopping a current from said D.C. power source (52) to said transformer (51), and switching control means for outputting to said switching circuit (55) and switching control signal whose frequency varies with time to turn ON and OFF said switching circuit (55), said transformer (51) generating said A.C. voltage whose frequency varies with time at the secondary side of the transformer (51).

5. A developing apparatus as set forth in claim 4, wherein said switching control means comprises an oscillator (53) for outputting an oscillator signal having a predetermined frequency, and a programmable frequency divider (54) for switchingly frequency-dividing said oscillator signal (53) at a plurality of different frequency division ratios to output said switching control signal whose frequency varies with time, and wherein the frequency of said switching control signal varies cyclically in a predetermined order of a plurality of different frequencies.

6. A developing apparatus as set forth in claim 4, wherein said switching control means comprises a plurality of oscillators (56), (57) and (58) for outputting signals having a plurality of different frequencies, respectively, and switching means (59) for sequentially switching the output signals of said plurality of oscillators to output said switching control signal whose frequency varies with time, and wherein the frequency of said switching control signal varies cyclically in a predetermined order of a plurality of different frequencies.

7. A developing apparatus as set forth in claim 2, wherein said plurality of different frequencies of said A.C. voltage from said voltage applying means (50) are set according to the characteristics of said developer.

8. A developing apparatus as set forth in claim 3, wherein said plurality of different frequencies and said A.C. voltage from said voltage applying means (50) are determined according to the characteristics of said developer.

9. A developing apparatus as set forth in claim 1, wherein the width of said gap between said developer carrier (11) and said electrostatic latent image holder (6) is wider than the thickness of a toner layer on said developer carrier.

10. A developing apparatus comprising:

a rotatable cylindrical developing roller (11) for carrying toner thereon and provided spaced opposite a rotatable photosensitive drum (6) for carrying an electrostatic latent image to define a very small gap between said roller (11) and said drum (6);

means for supplying toner to a surface of said roller (11);

a blade (12) for forming the toner on the roller to a layer having a predetermined thickness; and an A.C. bias power supply (50) electrically connected to said roller (11) for applying an A.C. voltage whose frequency varies with time to said gap between said rum (6) and roller (11), whereby said varying portions of the toner carried on the roller (11) are successively caused to fly to an electrostatic latent image formed on said drum (6) under the influence of an alternating electric field established by said A.C. voltage.

11. A developing apparatus as set forth in claim 10, wherein said A.C. voltage from said A.C. bias power supply (50) has a period in which a plurality of different frequencies sequentially appear stepwise, and said A.C. voltage is set so that said period occurs at least once during a time in which said electrostatic latent image passes through an effective developing region in said gap between said roller and said drum.

* * * * *